US007468712B2

(12) United States Patent
Son et al.

(10) Patent No.: US 7,468,712 B2
(45) Date of Patent: Dec. 23, 2008

(54) PLASMA DISPLAY PANEL AND DRIVING METHOD THEREOF

(75) Inventors: Jin-Boo Son, Cheonan (KR); Kwang-Ho Jin, Cheonan (KR); Jin-Sung Kim, Cheonan (KR); Jea-Hyuk Lim, Asan (KR); Jin-Won Nam, Asan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 704 days.

(21) Appl. No.: 10/796,597

(22) Filed: Mar. 9, 2004

(65) Prior Publication Data

US 2004/0212560 A1 Oct. 28, 2004

(30) Foreign Application Priority Data

Apr. 22, 2003 (KR) ..... 10-2003-0025543
Sep. 2, 2003 (KR) ..... 10-2003-0061185

(51) Int. Cl.
*G09G 3/28* (2006.01)

(52) U.S. Cl. ..... 345/60; 345/63; 345/72; 345/66; 345/69

(58) Field of Classification Search ..... 345/60–69, 345/72; 313/486, 587, 582, 306, 586, 584; 315/169.1–169.4
See application file for complete search history.

(56) References Cited

U.S. PATENT DOCUMENTS 6,034,482 A 3/2000 Kanazawa et al.
6,087,779 A * 7/2000 Sakamoto et al. ..... 315/169.1
6,104,362 A * 8/2000 Kuriyama et al. ..... 345/63
6,160,529 A * 12/2000 Asao et al. ..... 345/60
6,184,849 B1 * 2/2001 Stoller ..... 345/72
RE37,083 E * 3/2001 Kanazawa ..... 315/169.4
6,483,250 B1 11/2002 Hashimoto et al.
6,512,501 B1 * 1/2003 Nagaoka et al. ..... 345/66
6,577,061 B2 * 6/2003 Sano et al. ..... 313/582

(Continued)

FOREIGN PATENT DOCUMENTS

EP 0 657 861 A1 6/1995

(Continued)

OTHER PUBLICATIONS

Korean Patent Abstracts for Publication No.: 1020040065711, Date of publication of application Jul. 23, 2004, in the name of Y. Jun et al.

(Continued)

*Primary Examiner*—Prabodh Dharia
(74) *Attorney, Agent, or Firm*—Christie, Parker & Hale, LLP

(57) ABSTRACT

Disclosed is a PDP driving method having a misfiring erase period between reset and address periods. Large amounts of positive and negative charges are respectively formed on scan and sustain electrodes because of an unstable reset operation in the reset period. Because of the charges, discharging can occur between the scan and sustain electrodes in the sustain period even without addressing in the address period. In the misfiring erase period, a voltage is applied between the scan and sustain electrodes to generate discharging and respectively form negative and positive charges on the scan and sustain electrodes. An erase pulse is then applied to erase the negative and positive charges respectively formed on the scan and sustain electrodes.

62 Claims, 11 Drawing Sheets

U.S. PATENT DOCUMENTS

| | | | | |
|---|---|---|---|---|
| 6,603,263 | B1 * | 8/2003 | Hashimoto et al. | 313/584 |
| 6,603,446 | B1 * | 8/2003 | Kanazawa et al. | 345/60 |
| 6,608,609 | B1 * | 8/2003 | Setoguchi et al. | 345/60 |
| 6,628,087 | B2 | 9/2003 | Roh et al. | |
| 6,646,375 | B1 * | 11/2003 | Nagano | 313/582 |
| 6,836,261 | B1 * | 12/2004 | Kishi et al. | 345/60 |
| 6,856,305 | B2 * | 2/2005 | Nagano | 345/60 |
| 6,956,546 | B1 * | 10/2005 | Hashimoto et al. | 345/60 |
| 6,982,685 | B2 * | 1/2006 | Hashimoto et al. | 345/62 |
| 7,012,579 | B2 | 3/2006 | Choi | |
| 7,030,839 | B2 * | 4/2006 | Higashino et al. | 345/60 |
| 2002/0047572 | A1 * | 4/2002 | Kanazawa | 315/169.3 |
| 2002/0093291 | A1 | 7/2002 | Kanazawa et al. | |
| 2002/0180354 | A1 * | 12/2002 | Sano et al. | 313/582 |
| 2002/0180669 | A1 | 12/2002 | Kim et al. | |
| 2003/0020674 | A1 * | 1/2003 | Higashino et al. | 345/60 |
| 2003/0071577 | A1 | 4/2003 | Du et al. | |
| 2003/0080682 | A1 * | 5/2003 | Nagano | 313/582 |
| 2003/0080926 | A1 * | 5/2003 | Morimoto | 345/60 |
| 2004/0155836 | A1 | 8/2004 | Kim et al. | |
| 2005/0052353 | A1 * | 3/2005 | Shiizaki et al. | 345/60 |
| 2005/0168407 | A1 * | 8/2005 | Lee et al. | 345/60 |

FOREIGN PATENT DOCUMENTS

| | | | |
|---|---|---|---|
| EP | 0 903 719 | A2 | 3/1999 |
| EP | 0 939 391 | A1 | 9/1999 |
| JP | 07-160218 | | 6/1995 |
| JP | 07-175438 | | 7/1995 |
| JP | 10-143108 | | 5/1998 |
| JP | 10-274955 | | 10/1998 |
| JP | 10-319901 | | 12/1998 |
| JP | 11-133913 | | 5/1999 |
| JP | 2000-214822 | | 8/2000 |
| JP | 2000-259117 | | 9/2000 |
| JP | 2001-013910 | | 1/2001 |
| JP | 2001-272946 | | 10/2001 |
| JP | 2002-082650 | | 3/2002 |
| JP | 2002-351383 | | 12/2002 |
| JP | 2003-015600 | | 1/2003 |
| JP | 2003-084712 | | 3/2003 |
| KR | 1999-0085967 | | 12/1999 |
| KR | 10-2004-0065711 | | 7/2004 |

OTHER PUBLICATIONS

European Search Report, dated Feb. 8, 2005, for application No. 04090066.4, in the name of Samsung SDI Co., Ltd.

European Patent Office Patent Abstracts of Japan, for publication No. 2002351383, publication date Dec. 6, 2002. in the name of Takeda Minoru.

European Patent Office Patent Abstracts of Japan, for publication No. 2001272946, publication date Oct. 5, 2001, in the name of Takeda Minoru.

Patent Abstracts of Japan, for publication No. 2002-351383, publication date Dec. 6, 2002, in the name of Takeda Minoru.

Patent Abstracts of Japan, for publication No. 2001-272946, publication date Oct. 5, 2001, in the name of Shoji Takatoshi.

Korean Patent Laid-Open Publication(A) Abstract for Korean publication No. 1019990085967A.

European Communication dated Jan. 10, 2008, for corresponding European Patent Application EP 04 090 066.4, indicating relevance of reference EP 0 939 391, previously filed in an IDS dated Feb. 12, 2008.

Patent Abstracts of Japan for publication No. 10-143108, published on May 29, 1998 in the name of Kanazawa.

Patent Abstracts of Japan for publication No. 07-160218, published on Jun. 23, 1995 in the name of Kanazawa.

Patent Abstracts of Japan for Publication No. 2000-259117, published on Sep. 22, 2000 in the name of Nagao et al.

Patent Abstracts of Japan for Publication No. 2003-084712, published on Mar. 19, 2003 in the name of Kim et al.

Patent Abstracts of Japan for Publication No. 07-175438, published on Jul. 14, 1995 in the name of Sakamoto et al.

Patent Abstracts of Japan for Publication No. 10-274955 published on Oct. 13, 1998 in the name of Ito et al.

Patent Abstracts of Japan for Publication No. 10-319901 published on Dec. 4, 1998 in the name of Guen et al.

Patent Abstracts of Japan for Publication No. 11-133913 published on May 21, 1999 in the name of Nagaoka et al.

Patent Abstracts of Japan for Publication No. 2000-214822, published on Aug. 4, 2000 in the name of Ishizuka.

Patent Abstracts of Japan for Publication No. 2001-013910, published on Jan. 19, 2001 in the name of Nagaoka et al.

Patent Abstracts of Japan for Publication No. 2002-082650, published on Mar. 22, 2002 in the name of Tanaka et al.

Patent Abstracts of Japan for Publication No. 2003-015600, published on Jan. 17, 2003 in the name of Roh et al.

* cited by examiner

PLASMA DISPLAY PANEL AND DRIVING METHOD THEREOF

CROSS REFERENCE TO RELATED APPLICATION

This application claims priority to and the benefit of Korean Patent Application Nos. 2003-25543 and 2003-61185 filed on Apr. 22, 2003 and Sep. 2, 2003, respectively, in the Korean Intellectual Property Office, the entire contents of both of which are incorporated herein by reference.

BACKGROUND OF THE INVENTION (a) Field of the Invention

The present invention relates to a plasma display panel (PDP) and a driving method thereof, and more particularly to a PDP driving method that can prevent discharging in the sustain period of discharge cells that are not selected in the address period.

(b) Description of the Related Art

A PDP is a flat display for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP, and FIG. 2 schematically shows an electrode arrangement of the PDP.

As shown in FIG. 1, the PDP includes glass substrates 1 and 6 facing each other with a predetermined gap therebetween. Scan electrodes 4 and sustain electrodes 5 in pairs are formed in parallel on the glass substrate 1, and the scan electrodes 4 and the sustain electrodes are covered with a dielectric layer 2 and a protection film 3. A plurality of address electrodes 8 is formed on the glass substrate 6, and the address electrodes 8 are covered with an insulator layer 7. Barrier ribs 9 are formed on the insulator layer 7 between the address electrodes 8, and phosphors 10 are formed on the surface of the insulator layer 7 and between the barrier ribs 9. The glass substrates 1 and 6 are provided facing each other with discharge spaces between the glass substrates 1 and 6 so that the scan electrodes and the sustain electrodes 5 can cross the address electrodes 8. A discharge space 11 between an address electrode 8 and a crossing part of a pair of a scan electrode 4 and a sustain electrode 5 forms a discharge cell 12, which is schematically indicated.

As shown in FIG. 2, the electrodes of the PDP have an n×m matrix format. The address electrodes A1 to Am are arranged in the column direction, and n scan electrodes Y1 to Yn and n sustain electrodes X1 to Xn are arranged in the row direction.

In general, a single frame is divided into a plurality of subfields in the PDP, and displayed images are represented by a combination of the subfields. As shown in FIG. 3, each subfield has a reset period, an address period, and a sustain period. In the reset period, wall charges formed by previous sustain-discharging are erased, and the wall charges are set up so that the next addressing can be stably performed. In the address period, cells that are turned on and those that are turned off are selected, and the wall charges are accumulated to the cells that are turned on (i.e., addressed cells). In the sustain period, sustain-discharging is executed so as to display the actual image on the addressed cells.

FIG. 3 shows a conventional PDP driving waveform. As shown, a reset period includes an erase period (a), a ramp rising period (b), and a ramp falling period (c).

In the erase period (a), an erase ramp waveform that gradually rises toward Ve volts (V) from 0V is applied to a sustain electrode X. This way, the wall charges formed on the sustain electrode X and the scan electrode Y are gradually erased. As used herein, the wall charges refer to charges that accumulate to the electrodes and formed proximately to the respective electrodes on the wall (e.g., dielectric layer) of the discharge cells. The wall charges do not actually touch the electrodes themselves, but they are described herein as being "formed on", "stored on" and/or "accumulated to" the electrodes. Further, the wall voltage as used herein refers to a voltage potential that exists on the wall of discharge cells, which is caused by the wall charges.

In the ramp rising period (b), the address electrode A and the sustain electrode X are maintained at 0V, and a ramp waveform that gradually rises toward Vset volts from Vs volts is applied to the scan electrode Y. While the ramp waveform rises, first fine resetting is generated to the address electrode A and the sustain electrode X from the scan electrode Y in all the discharge cells. Accordingly, negative wall charges are stored on the scan electrode Y, and positive charges are concurrently stored on the address electrode A and the sustain electrode X.

In the ramp falling period (c), a ramp waveform that gradually falls toward 0V from Vs volts is applied to the scan electrode Y while the sustain electrode X is maintained at Ve volts. While the ramp waveform falls, second fine resetting is generated to all the discharge cells. As a result, the negative wall charges of the scan electrode Y reduce, and the positive wall charges of the sustain electrode X reduce.

When the reset period operates normally, the wall charges of the scan electrode Y and the sustain electrode X are erased, but unstable discharging may occur because of unstable resetting. The unstable discharging includes a first case in which discharging caused by self-erasing occurs at the time when voltage of the scan electrode Y falls to Vs after strong discharging during a ramp rising period, a second case in which strong discharging occurs in a ramp rising period and a ramp falling period, and a third case in which strong discharging occurs during a ramp falling period.

In the first case, a reset function is performed according to self-erasing. However, in the second and third cases, positive wall charges are generated on the scan electrode Y and negative wall charges are generated on the sustain electrode X because of strong discharging during the ramp falling period. In these instances, if a wall voltage Vwxy1 caused by the wall charges formed on the scan electrode Y and the sustain electrode X satisfies Equation 1, sustain-discharging can be generated in the sustain period even when no addressing occurs in the address period.

$$V_{wxy1}+V_s>V_f \qquad \text{Equation 1}$$

where Vwxy1 is the wall voltage formed between the scan electrode Y and the sustain electrode X because of strong discharging in the ramp falling period; Vs is a voltage difference generated between the scan electrode Y and the sustain electrode X because of sustain pulses applied in the sustain period; and Vf is a discharge firing voltage between the scan electrode Y and the sustain electrode X.

Therefore, when the conventional driving method of FIG. 3 is used in a PDP, sustain-discharging can occur in the discharge cells that are not to be turned on because of strong discharging during the ramp failing period in the reset period.

SUMMARY OF THE INVENTION

In one exemplary embodiment of the present invention, misfiring that may occur because of strong discharging in the reset period is minimized or prevented.

To minimize or prevent such misfiring, the charges formed by an unstable reset operation are erased.

In an exemplary embodiment of the present invention is provided a method for driving a PDP including a plurality of first electrodes and second electrodes formed in parallel on a first substrate, and a plurality of third electrodes crossing the first and second electrodes and being formed on a second substrate, wherein adjacent said first, second, and third electrodes define each of a plurality of discharge cells. The method includes: setting the plurality of discharge cells in a first reset period; further setting the plurality of discharge cells in a second reset period; selecting at least one discharge cell from among the plurality of discharge cells in an address period; and sustain-discharging said at least one discharge cell in a sustain period.

In another exemplary embodiment, said further setting includes applying a discharge erase pulse under a predetermined condition to the plurality of discharge cells. The discharge erase pulse has discharge and erase functions.

In yet another exemplary embodiment, the predetermined condition includes a case in which abnormal charges are formed in the first reset period, and the abnormal charges formed in the first reset period are discharged and erased responsive to the discharge erase pulse.

In still another exemplary embodiment, the abnormal charges include first and second charges respectively formed on the first and second electrodes in the first reset period, and a voltage caused by the first and second charges is sufficient for sustaining in the sustain period discharge cells that are not selected in the address period.

In a further exemplary embodiment, the second reset period includes a first period and a second period, and said further setting includes: applying a first voltage to the first electrode during a first period; and applying a second voltage to the second electrode during a second period.

In a yet further exemplary embodiment, the first voltage, together with the voltage caused by the first and second charges, is sufficient for generating a discharge between the first and second electrodes.

In a still further exemplary embodiment, charges accumulate responsive to the discharge in the first period to the first and second electrodes, and the second voltage is used in the second period to erase the charges formed in the first period.

In another exemplary embodiment, the second voltage gradually changes from a third voltage to a fourth voltage.

In yet another exemplary embodiment, the second voltage, together with a voltage caused by the charges formed in the first period, is sufficient for generating another discharge between the first and second electrodes, and charges accumulated to the first and second electrodes in the second period responsive to said another discharge is less than a predetermined amount of charges.

In still another exemplary embodiment, the second voltage is applied to the second electrode while the first voltage is applied to the first electrode in the second reset period.

In a further exemplary embodiment, the first voltage is applied to the first electrode during a predetermined period, a voltage difference between the first and second voltages, together with a voltage caused by the first and second charges, is sufficient for generating a discharge between the first and second electrodes, and charges accumulated to the first and second electrodes in the predetermined period responsive to the discharge is less than a predetermined amount of charges.

In a yet further exemplary embodiment, the predetermined amount is within a range that prevents sustaining in the sustain period of discharge cells that are not selected.

In a still further exemplary embodiment, the first voltage gradually changes from a third voltage to a fourth voltage.

In a still further exemplary embodiment, the plurality of discharge cells are additionally set at least once more in at least one additional reset period.

In another exemplary embodiment of the present invention is provided a method for driving a PDP including a plurality of first electrodes and second electrodes formed in parallel on a first substrate, and a plurality of third electrodes crossing the first and second electrodes and being formed on a second substrate, wherein adjacent said first, second, and third electrodes define each of a plurality of discharge cells. The method includes: setting the plurality of discharge cells when a predetermined condition is provided in a reset period, said setting including generating a discharge and erasing, which include: applying to the plurality discharge cells a discharge pulse for generating a discharge between the first and second electrodes under the predetermined condition in the reset period; and applying to the plurality of discharge cells an erase pulse for erasing the charges formed on the first and second electrodes responsive to the discharge.

In yet another exemplary embodiment, the predetermined condition includes a case in which abnormal charges have been formed in the reset period.

In still another exemplary embodiment, the abnormal charges include first and second charges respectively formed on the first and second electrodes in the reset period, and a voltage caused by the first and second charges is sufficient for sustain-discharging in a sustain period discharge cells that are not selected in an address period.

In a further exemplary embodiment of the present invention, a PDP includes: a first substrate; a plurality of first and second electrodes respectively formed substantially in parallel on the first substrate; a second substrate facing the first substrate with a predetermined distance therebetween; a plurality of third electrodes crossing the first and second electrodes, and being formed on the second substrate; and a driving circuit for supplying a driving signal to a discharge cell defined by adjacent said first, second, and third electrodes, wherein the driving circuit applies a first voltage to the first electrode and a second voltage to the second electrode between reset and address periods, and abnormal charges from among the charges formed in the reset period are erased by the first and second voltages.

In a still further exemplary embodiment, the driving circuit applies the first voltage to the first electrode and the second voltage to the second electrode at least once more between the reset and address periods.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain exemplary embodiments of the present invention are shown and described, simply by way of illustration. As will be realized, the described exemplary embodiments can be modified in various different ways, all without departing from the spirit or scope of the present invention. Accordingly, the drawings and description are to be regarded as illustrative in nature, and not restrictive.

Figure 1:
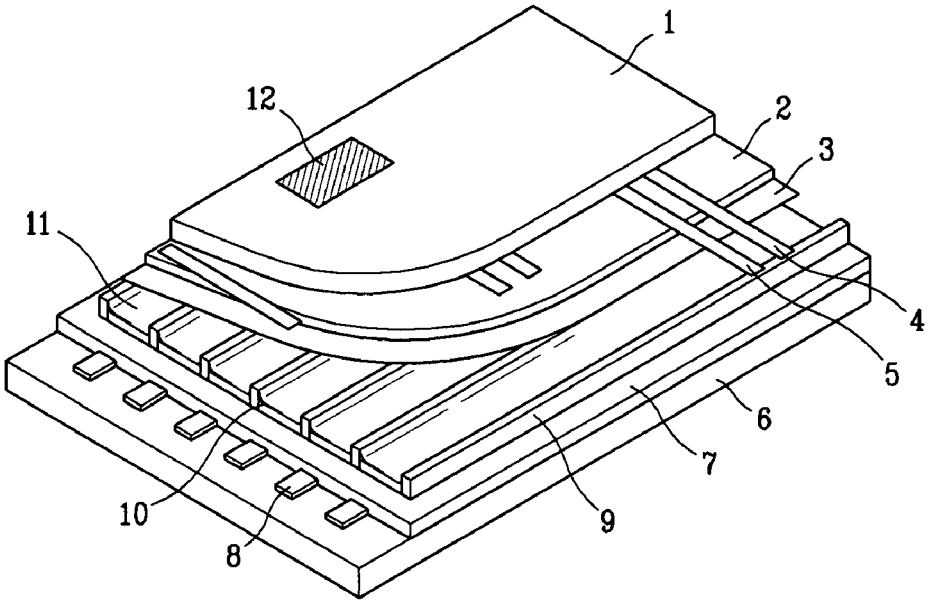
FIG.1(Prior Art)
FIG. 1 shows a partial perspective view of a PDP.
Figure 2:
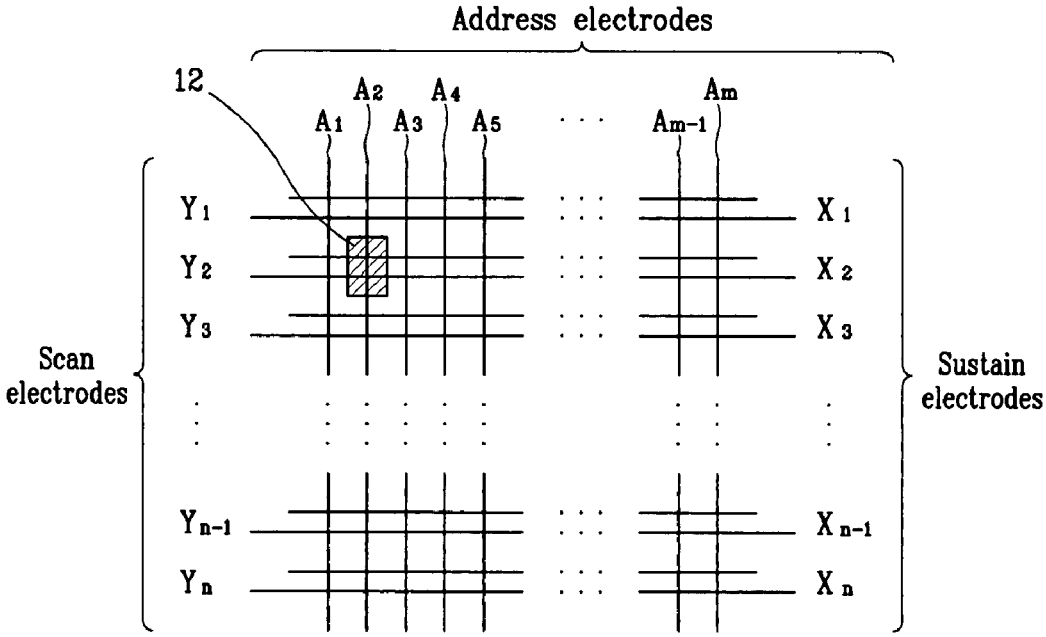
FIG.2(Prior Art)
FIG. 2 shows an electrode arrangement of a PDP.
Figure 3:
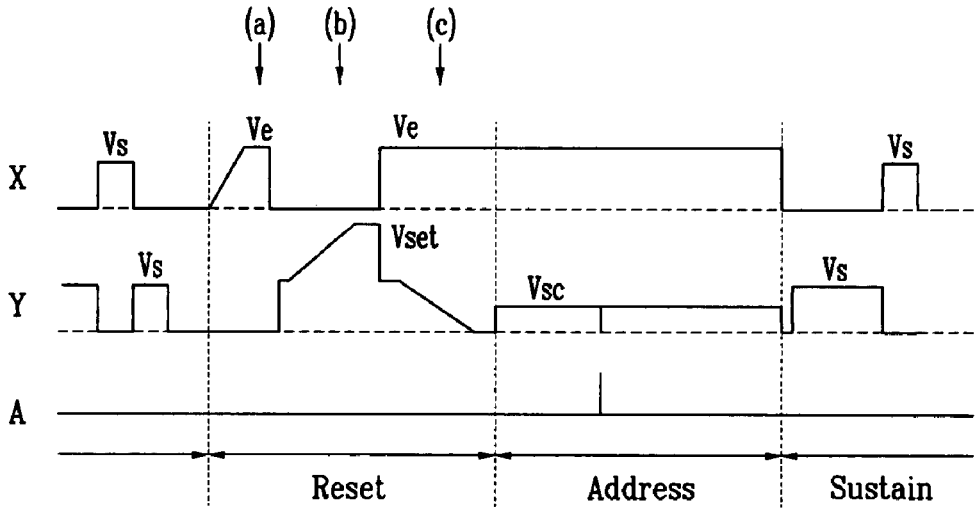
FIG.3(Prior Art)
FIG. 3 shows a conventional PDP driving waveform diagram.
Figure 4:
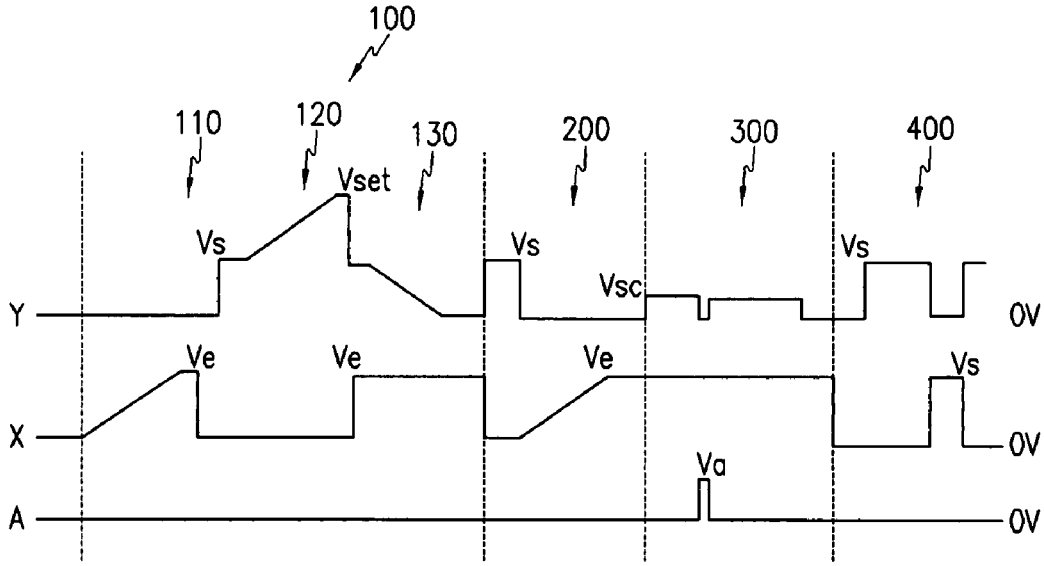
FIG. 4 shows a PDP driving waveform diagram according to an exemplary embodiment of the present invention.
Figure 5A:
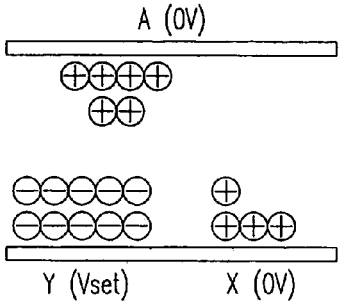
FIGS. 5A to 5D respectively show distribution diagrams of wall charges responsive to the driving waveform of FIG. 4.
Figure 5B:
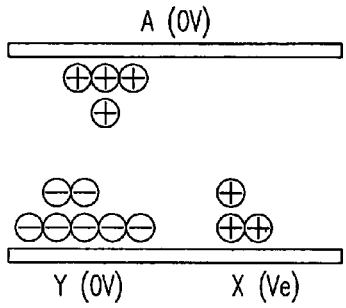
Figure 5C:
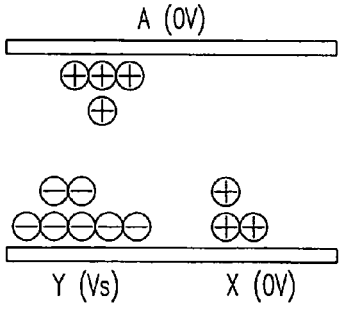
Figure 5D:
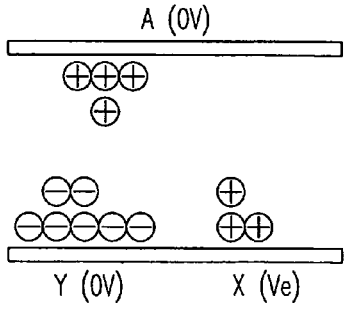
Figure 6A:
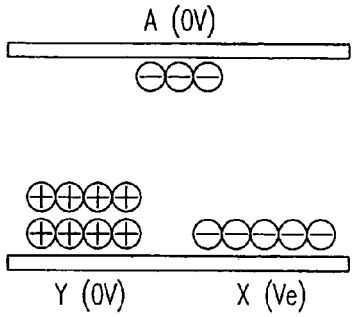
FIGS. 6A to 6C respectively show distribution diagrams of wall charges when an unstable reset operation occurs in the driving waveform of FIG. 4.
Figure 6B:
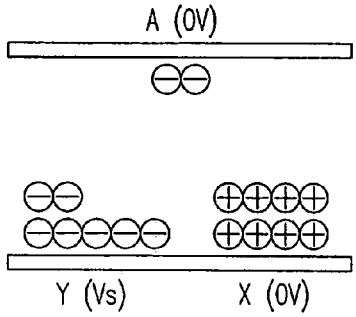
Figure 6C:
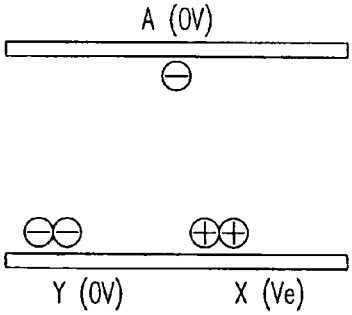
Figure 7:
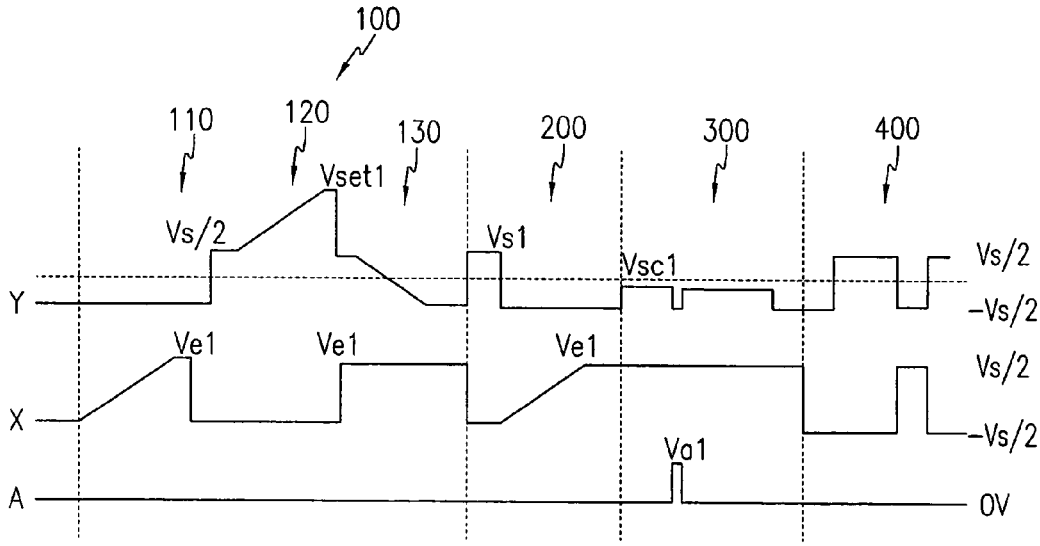
FIGS. 7 and 8 respectively show PDP driving waveforms in other exemplary embodiments of the present invention.
Figure 8:
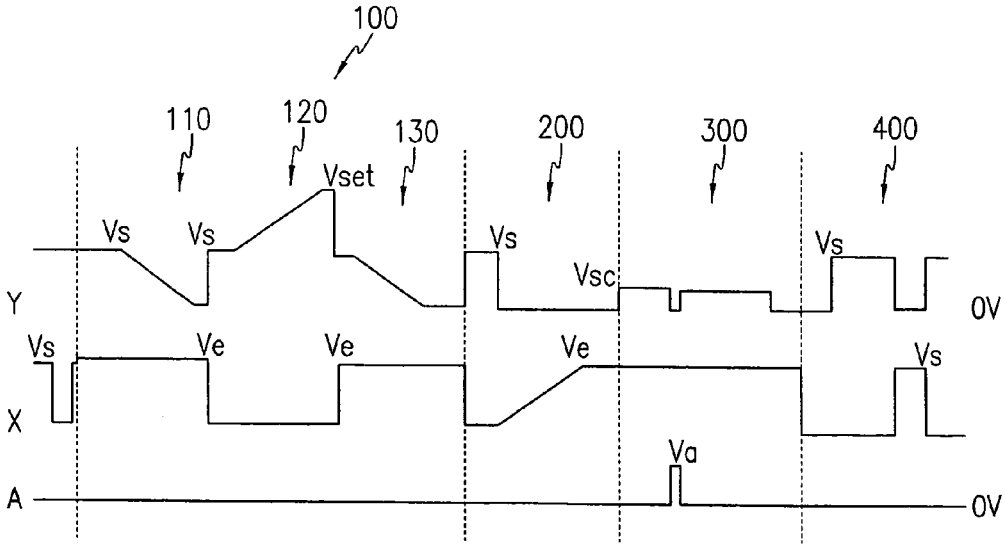

FIG. 4 shows a PDP driving waveform diagram according to an exemplary embodiment of the present invention. FIGS. 5A to 5D respectively show distribution diagrams of wall charges responsive to the driving waveform of FIG. 4. FIGS. 6A to 6C respectively show distribution diagrams of wall charges when strong discharging occurs during a ramp falling period of a reset period in the driving waveform of FIG. 4. FIGS. 7 and 8 respectively show PDP driving waveforms in other exemplary embodiments according to the present invention.

As shown in FIG. 4, the driving waveform according to an exemplary embodiment of the present invention includes a reset period 100, a misfiring erase period 200, an address period 300, and a sustain period 400. The reset period 100 includes an erase period 110, a ramp rising period 120, and a ramp falling period 130.

In the erase period 110 of the reset period 100, the charges formed while sustaining in the sustain period of a previous subfield are erased. In the ramp rising period 120, the wall charges are formed on the scan electrode Y, the sustain electrode X, and the address electrode A. In the ramp falling period 130, part of the wall charges formed during the ramp rising period 120 are erased so that addressing can easily be performed.

In the misfiring erase period 200, the wall charges of the scan electrode Y and the sustain electrode X formed by unstable strong discharging during the ramp falling period 130 are erased. This way, a charge state that enables a normal emission of light is formed by further setting the discharge cells. Hence, the misfiring erase period 200 may also be referred to as a second reset period, which is used to supplement the reset period 100.

In the address period 300, discharge cells for generating sustaining discharge in the sustain period are selected from among a plurality of discharge cells. In the sustain period 400, sustain pulses are sequentially applied to the scan electrode Y and the sustain electrode X to sustain the discharge cells selected during the address period 300.

The PDP includes a scan/sustain driving circuit for applying a driving voltage to the scan electrode Y and the sustain electrode Y, and an address driving circuit for applying a driving voltage to the address electrode A in the respective periods 100 to 400.

Referring to FIGS. 5A to 5D, a reset operation normally generated in response to the driving waveform according to the exemplary embodiment of FIG. 4 will now be described in detail.

In the sustain period of a previous subfield, negative wall charges were accumulated to the scan electrode Y, and positive wall charges were accumulated to the sustain electrode X because of sustaining between the scan electrode Y and the sustain electrode X. In the erase period 110, a ramp waveform that gradually rises to Ve volts from the reference voltage is applied to the sustain electrode X while the scan electrode Y is maintained at a reference voltage. The reference voltage is set as 0V in the exemplary embodiment of FIG. 4. This way, the wall charges formed on the sustain electrode X and the scan electrode Y are gradually erased.

Next, in the ramp rising period 120, a ramp waveform that gradually rises to Vset from Vs volts is applied to the scan electrode Y while the sustain electrode X is maintained at the reference voltage. In this instance, Vs is less than the discharge firing voltage Vf between the scan electrode Y and the sustain electrode X, whereas Vset is greater than the discharge firing voltage Vf. Fine resetting is respectively generated to the address electrode A and the sustain electrode X from the scan electrode Y while the ramp waveform rises. As a result, as shown in FIG. 5A, the negative wall charges are accumulated to the scan electrode Y, and the positive wall charges are concurrently accumulated to the address electrode A and the sustain electrode X.

In the ramp falling period 130, a ramp waveform that gradually falls to the reference voltage from Vs is applied to the scan electrode Y while the sustain electrode X is maintained at Ve. Fine resetting occurs in all the discharge cells while the ramp waveform falls. As a result, as shown in FIG. 5B, the negative wall charges of the scan electrode Y reduce, and the positive wall charges of the sustain electrode X reduce. Also, the positive wall charges of the address electrode A are controlled to a value appropriate for an addressing operation.

In the misfiring erase period 200, a square pulse having Vs volts (e.g., first voltage) is applied to the scan electrode Y while the sustain electrode X is maintained at the reference voltage. In this instance, when the charges are normally erased in the ramp falling period 130, the wall charges formed between the scan electrode Y and the sustain electrode X become a negative voltage−Vwxy2 with reference to the scan electrode Y. The voltage between the scan electrode Y and the sustain electrode X becomes (Vs−Vwxy2) that is not greater than the discharge firing voltage Vf; hence, discharge is not generated. Therefore, as shown in FIG. 5C, the distribution of the wall charges in the discharge cells is maintained in the like manner as FIG. 5B.

Next, in the misfiring erase period 200, an erase ramp (e.g., second voltage) waveform that gradually rises to Ve (e.g., fourth voltage) from the reference voltage (e.g., third voltage) is applied to the sustain electrode X while the scan electrode Y is maintained at the reference voltage. Since the charge distribution at the scan electrode Y and the sustain electrode X have the same period as the previous one, and no discharge occurs by the erase ramp waveform, the wall charges are maintained in the like manner as FIG. 5B, as shown in FIG. 5D.

In the address period 300, scan pulses are sequentially applied to the scan electrode Y so as to select discharge cells, and address pulses are applied to the desired address electrode A from among the address electrodes A that cross the scan electrodes Y to which the scan pulses are applied. Discharging occurs between the scan electrode Y and the address electrode A according to a potential difference formed by the scan pulses and the address pulses. Discharging occurs between the scan electrode Y and the sustain electrode X when the discharging between the scan electrode Y and the address electrode A starts, to thereby form wall charges on the scan electrode Y and the sustain electrode X.

In the sustain period 400, sustain pulses are sequentially applied to the scan electrode Y and the sustain electrode X. The sustain pulses allow the voltage difference between the scan electrode Y and the sustain electrode X to be Vs and −Vs alternately. Vs is less than the discharge firing voltage between the scan electrode Y and the sustain electrode X. When a wall voltage Vwxy3 is formed between the scan electrode Y and the sustain electrode X according to addressing in the address period 300, discharging occurs in the scan electrode Y and the sustain electrode X because of the wall voltage Vwxy3 and the Vs.

Next, referring to FIGS. 6A to 6C, a case when strong discharging occurs in the ramp falling period 130 of the PDP driving waveform according to the exemplary embodiment of FIG. 4 will be described in detail.

When strong discharging occurs because of an unstable reset operation in the ramp falling period 130, positive charges are accumulated to the scan electrode Y, and negative charges are accumulated to the sustain electrode X, as shown in FIG. 6A. In this instance, the wall voltage Vwxy1 formed by the wall charges generated on the scan electrode Y and the sustain electrode X satisfies the previously discussed Equation 1. Hence, sustain-discharging can be generated in the sustain period even when no addressing occurs in the address period, unless the charges are erased/reduced in the intervening misfiring erase period 200.

When Vs is applied to the scan electrode Y, and the reference voltage to the sustain electrode X in the misfiring erase period 200, the voltage (Vwxy1+Vs) between the scan electrode Y and the sustain electrode X becomes greater than the discharge firing voltage Vf because of the wall voltage Vwxy1 between the scan electrode Y and the sustain electrode X, and Vs. Therefore, discharging occurs between the scan electrode Y and the sustain electrode X, and a large amount of negative charges are accumulated to the scan electrode Y and a large amount of positive charges are accumulated to the sustain electrode X, as shown in FIG. 6B.

Next, in the latter part of the misfiring erase period 200, an erase ramp waveform that gradually rises to Ve from the reference voltage is applied to the sustain electrode X to perform an erase operation. As shown in FIG. 6C, the wall charges formed on the scan electrode Y and the sustain electrode X are erased because of the ramp waveform, and the wall voltage between the scan electrode Y and the sustain electrode X reduces. Accordingly, the summation of the wall voltage between the scan electrode Y and the sustain electrode X and Vs volts applied in the sustain period 300 becomes less than the discharge firing voltage Vf. Therefore, when no addressing occurs during the address period 300, no discharging occurs during the sustain period 400.

In the exemplary embodiment of FIG. 4, Vs volts are applied to the scan electrode Y, and Ve volts to the sustain electrode X in the misfiring erase period 200 so as to simplify the driving circuit. However, differing from this, different voltages can be applied to the scan electrode Y and the sustain electrode X when the discharging condition in the misfiring erase period 200 is satisfied. Further, the reference voltage is set as 0V in the exemplary embodiment of FIG. 4, but the reference voltage can be −Vs/2 and/or any other suitable voltage in other embodiments.

Referring to FIG. 7, the driving voltages applied to the scan electrode Y and the sustain electrode X in the respective periods 100, 200, 300, and 400 are reduced by Vs/2 as a whole. Hence, the voltage level used for the driving circuit reduces, and elements of low voltages can be used for the driving circuit. In other embodiments, voltages used in the respective periods 100 to 400 may be different. For example, referring to FIG. 8, in the erase period 110, the voltage applied to the sustain electrode X is maintained at voltage Ve, while a ramp waveform that gradually falls to the reference voltage from the sustain voltage Vs is applied to the scan electrode Y. This way, the voltage difference between the sustain electrode X and the scan electrode Y during the erase period 110 has a ramping similar to that of the PDP voltage waveform diagram of FIG. 4.

In the exemplary embodiment of FIG. 4, the discharge voltage and the erase ramp waveform are used in the misfiring erase period 200. Other waveforms can be used in other embodiments. Referring to FIGS. 9 to 13, certain exemplary embodiments using waveforms different from those of the PDP voltage waveform diagram of FIG. 4 in the misfiring erase period 200 (also referred to as a second reset period) will now be described.

FIGS. 9 to 13 respectively show PDP driving waveform diagrams according to other exemplary embodiments of the present invention.

Figure 9:
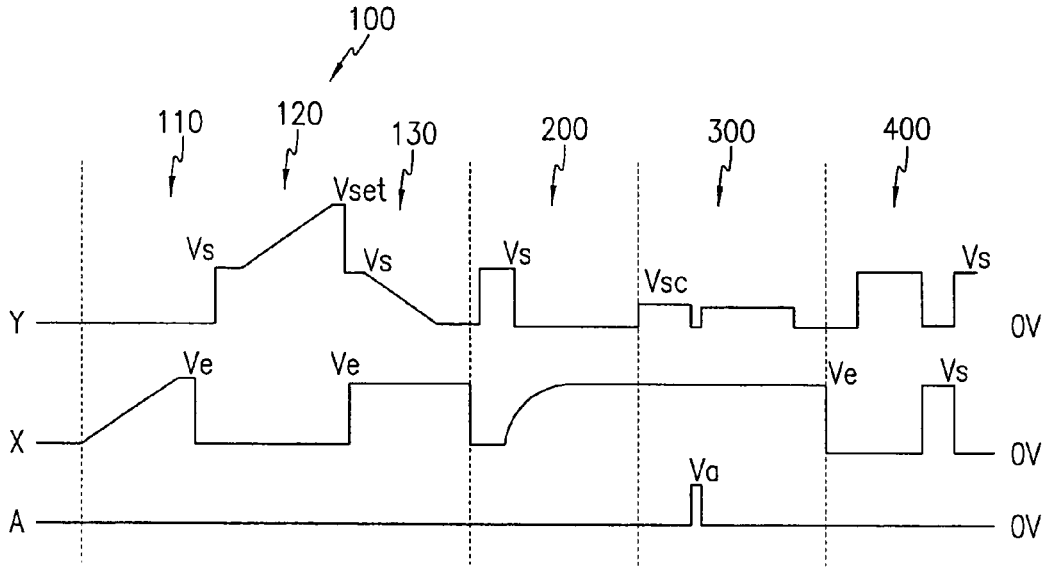
FIGS. 9 to 20 respectively show PDP driving waveform diagrams in still further exemplary embodiments of the present invention.

Referring to FIG. 9, the driving waveform is similar to that of the waveform of FIG. 4 except that round waveforms are used instead of the ramp waveforms in the misfiring erase period 200. In the former part of the misfiring erase period 200, a square pulse having Vs volts is applied to the scan electrode Y. A round voltage that rises in a convex curved manner (i.e., having a decreasing slope) to Ve from the reference voltage is applied to the sustain electrode X in the latter part of the misfiring erase period 200.

After strong discharging occurs in the ramp falling period 130, discharging occurs when Vs is applied in the former part of the misfiring erase period 200. Hence, negative charges are accumulated to the scan electrode Y and positive charges are accumulated to the sustain electrode X. These charges are erased in the latter part of the misfiring erase period 200 because of the round voltage that rises to Ve volts.

Figure 10:
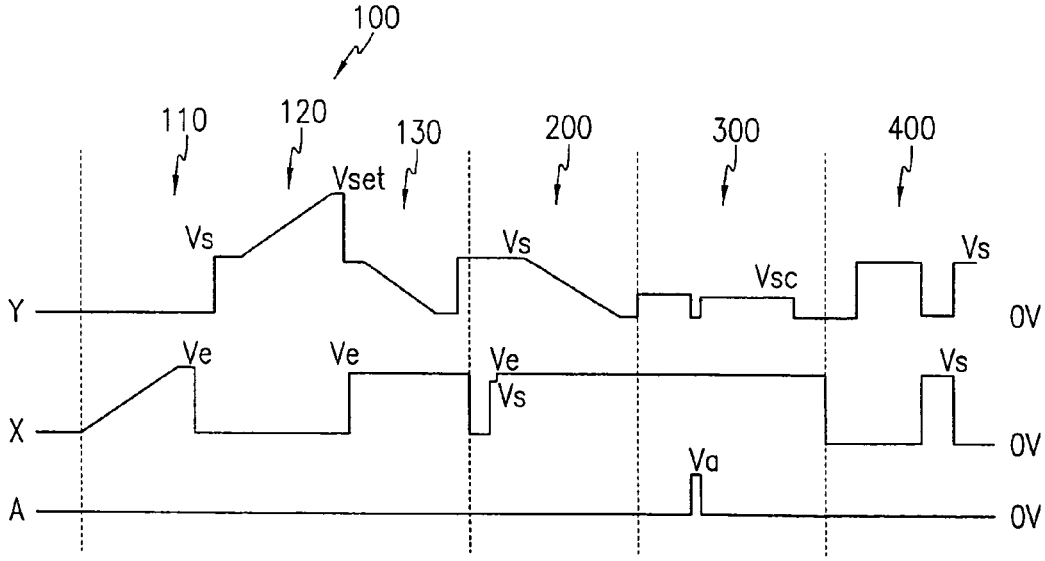

Referring to FIG. 10, unlike the waveform of FIG. 4, a square pulse is applied to the sustain electrode X, and a ramp waveform is applied to the scan electrode Y in the misfiring erase period 200. In detail, a square pulse that has the reference voltage is applied to the sustain electrode X while the scan electrode Y is maintained at Vs volts in the former part of the misfiring erase period 200. Since the voltage difference between the scan electrode Y and the sustain electrode X is maintained at Vs volts in the like manner as the exemplary embodiment of FIG. 4, discharging occurs between the scan electrode Y and the sustain electrode X when strong discharging has occurred in the ramp falling period 130. A ramp waveform that falls to the reference voltage from Vs is applied to the scan electrode Y while the sustain electrode X is maintained at Ve volts in the latter part of the misfiring erase period 200. The charges formed by discharging the scan electrode Y and the sustain electrode X in the former part of the misfiring erase period 200 can be removed because of the ramp waveform. In other embodiments, a round waveform similar to the one used in the exemplary embodiment of FIG. 9 may be used instead of the ramp waveform.

Figure 11:
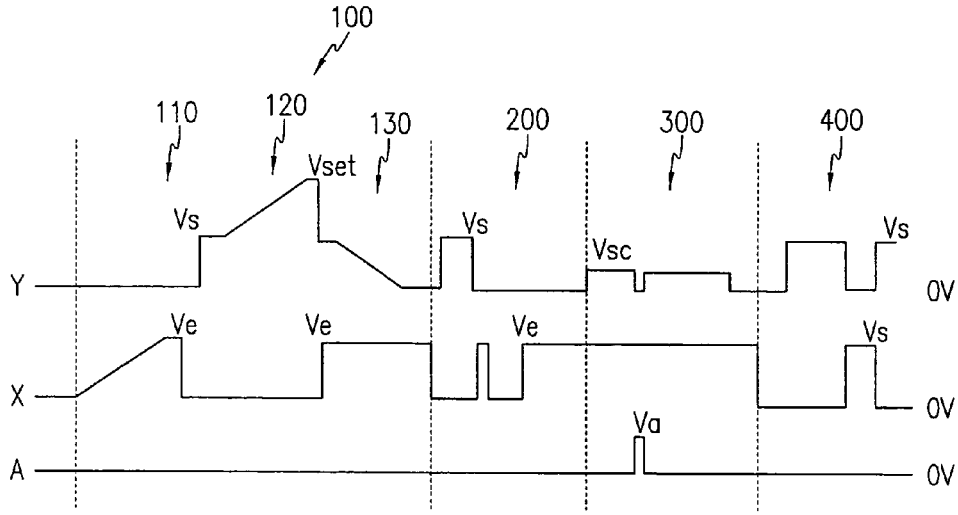

Referring to FIG. 11, the driving waveform according to another exemplary embodiment is similar to that of the waveform of FIG. 4 except that a narrow pulse is applied in the latter part of the misfiring erase period 200 rather than the erase ramp voltage. In detail, a narrow pulse with Ve volts is applied at the sustain electrode X while the scan electrode Y is maintained at the reference voltage in the latter part of the misfiring erase period 200.

When strong discharging has occurred in the ramp falling period 130, discharging occurs between the scan electrode Y and the sustain electrode X in the former part of the misfiring erase period 200, and the state of the wall charges becomes as shown in FIG. 6B. In this instance, when the reference voltage is applied to the scan electrode Y, and Ve volts to the sustain electrode X, discharging occurs between the scan electrode Y and the sustain electrode X because of a wall voltage Vwxy4 formed by the distribution of the wall charges of FIG. 6B and the voltage difference between the scan electrode Y and the sustain electrode X. However, because of the narrow width of the Ve voltage pulse applied to the sustain electrode X, the charges formed by discharging are not accumulated to the scan electrode Y and the sustain electrode X, but are erased. Therefore, the state of the wall charges becomes as shown in FIG. 6C.

A similar modification as in the waveform of FIG. 10 can be applied to the waveform of FIG. 11. That is, a square pulse that changes to the reference voltage from Ve volts is applied to the sustain electrode X while the scan electrode Y is maintained at Vs volts in the former part of the misfiring erase period 200. Next, while the sustain electrode X is maintained at Ve volts in the latter part of the misfiring erase period 200, a narrow pulse that changes to the reference voltage from Vs volts is applied to the scan electrode Y.

In the exemplary embodiments of FIGS. 4 and 7-11, discharging occurs in the misfiring erase period, and the charges formed by the discharging are then erased. In the exemplary embodiments of FIGS. 12 and 13, on the other hand, a waveform that performs concurrent discharging and erasing in the misfiring erase period is used. In the exemplary embodiments of FIGS. 12 and 13, as in the previously discussed exemplary embodiments, the misfiring erase period supplements the reset period, and may be referred to as a second reset period.

Figure 12:
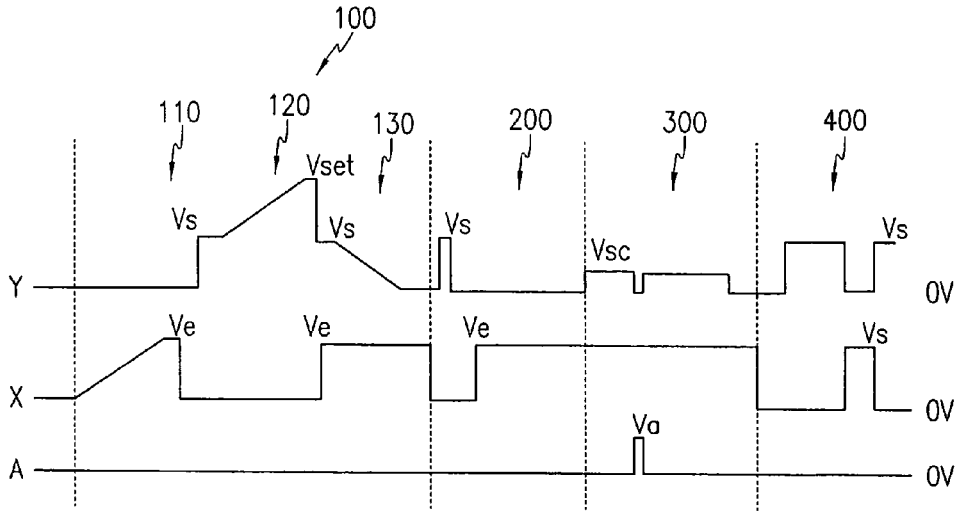

Referring to FIG. 12, in another embodiment, a narrow pulse is applied only to the scan electrode Y in the misfiring erase period 200. In detail, a narrow pulse with Vs volts is applied to the scan electrode Y while the sustain electrode X is maintained at the reference voltage in the misfiring erase period. When strong discharging occurs in the ramp falling period 130, and the state of the charges becomes as shown in FIG. 6A, discharging occurs between the scan electrode Y and the sustain electrode X because of the voltage difference Vs between the scan electrode Y and the sustain electrode X and the wall voltage Vwxy1 between the scan electrode Y and the sustain electrode X. The charges generated by discharging are not accumulated to the scan electrode Y and the sustain electrode X but are erased because of the narrow width of the pulse applied to the scan electrode Y.

Figure 13:
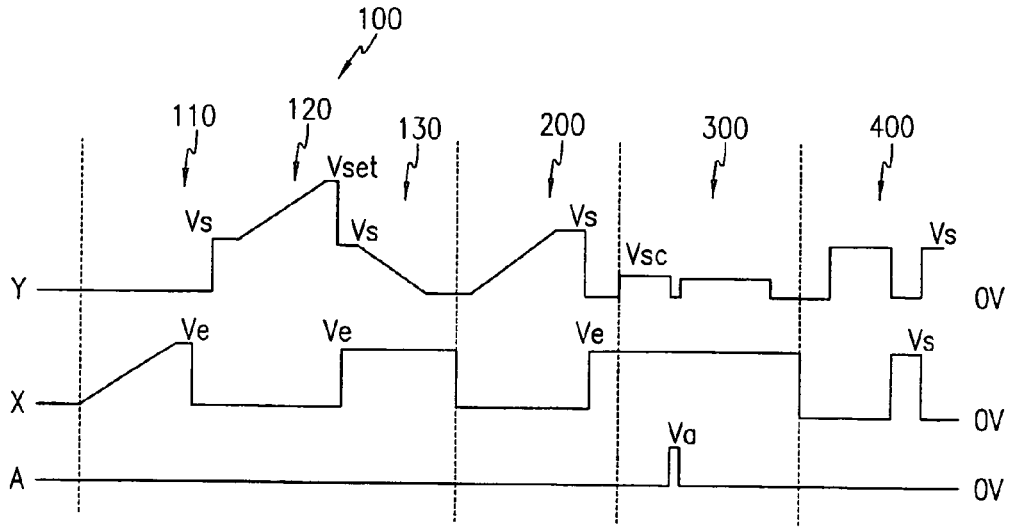

Referring to FIG. 13, in yet another exemplary embodiment, a ramp waveform is applied only to the scan electrode Y in the misfiring erase period 200. That is, a ramp waveform that gradually rises to Vs volts from the reference voltage is applied to the scan electrode Y while the sustain electrode X is maintained at the reference voltage. Then, when the charges are formed on the scan electrode Y and the sustain electrode X as shown in FIG. 6A, fine discharging occurs between the scan electrode Y and the sustain electrode X, and the charges are erased.

In the above-described exemplary embodiments, a misfiring erase period 200 is added between a reset period 100 and an address period 300. In some cases, the charges formed by an abnormal reset operation are not erased by a single misfiring erase operation because of characteristics of the discharge cells. In these cases, the misfiring erase period 200 is repeated n times between the reset period 100 and the address period 300, where n is an integer greater than or equal to two. The first to (n−1)th misfiring erase operations may be considered as priming operations and the nth misfiring erase operation as a normal misfiring erase operation. The process of repeating misfiring erase operations will now be described in detail with reference to FIGS. 14 to 16.

Figure 14:
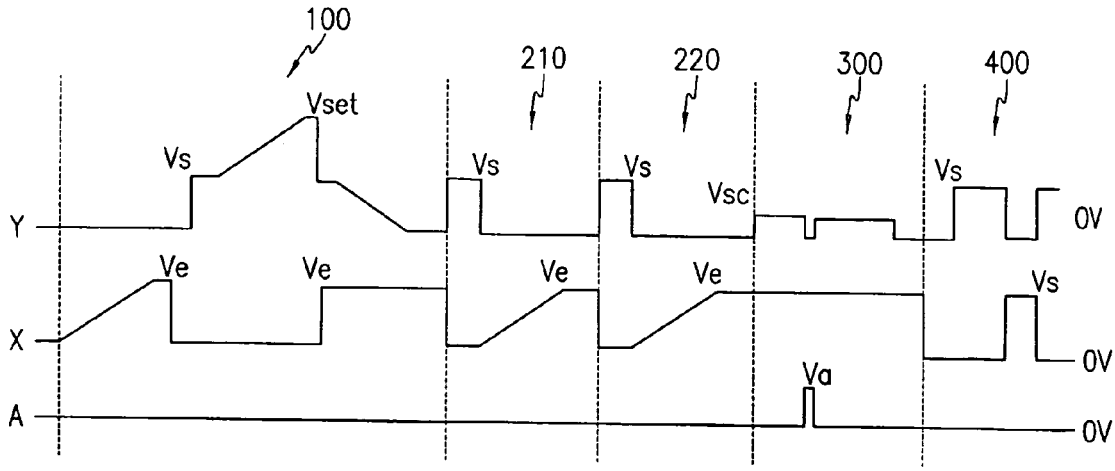
Figure 15:
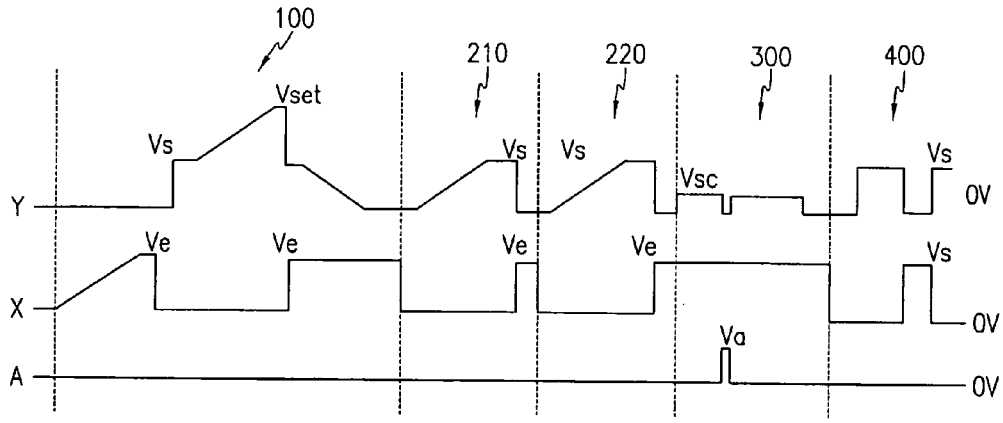
Figure 16:
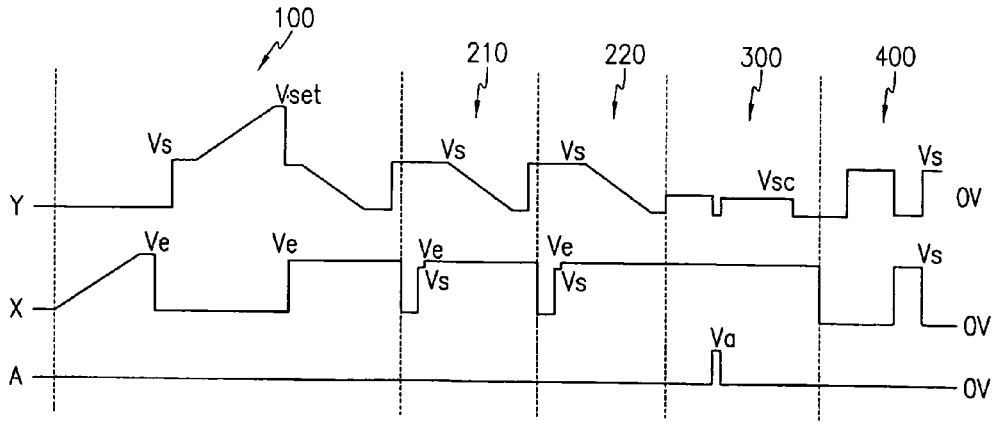

FIGS. 14 to 16 show PDP drive waveforms according to other exemplary embodiments. For ease of description, the misfiring erase period is illustrated in the drawings as being repeated twice. However, the number of misfiring erase periods in practice are not limited to two. In fact, the misfiring erase period may be repeated more than twice.

Referring to FIG. 14, the misfiring erase period 200 of FIG. 4 is repeated twice as a first misfiring erase period 210 and a second misfiring erase period 220. Accordingly, when the charges formed by the abnormal reset operation are not completely erased during the first misfiring erase period 210, the first misfiring erase period 210 may be considered as a priming period, and the charges are normally erased during the second misfiring erase period 220. Further, the round waveform or the narrow pulse of FIGS. 9 and 11, respectively, may be used instead of the ramp waveform during at least one of the misfiring erase periods 210 and 220.

Referring to FIG. 15, the misfiring erase period 200 of FIG. 13 is repeated twice as a first misfiring erase period 210 and a second misfiring erase period 220 between a reset period 100 and an address period 300. In this instance, a round waveform may be used instead of the ramp waveform during at least one of the first and second misfiring erase periods 210 and 220.

Referring to FIG. 16, the misfiring erase period 200 of FIG. 10 is repeated twice as first and second misfiring erase periods 210 and 220, respectively, between a reset period 100 and an erase period 300. In this instance, a round waveform or a narrow pulse of FIG. 12 may be used instead of the ramp waveform during at least one of the first and second misfiring erase periods 210 and 220.

As described with reference to FIGS. 14 to 16, the misfiring erase period of the same erase method may be repeated two or more times, in which the first misfiring erase operation(s) may be considered as priming operation(s) and the last misfiring erase operation may be considered as a normal misfiring erase operation. Differing from this, however, it is also possible that charges are not erased in the misfiring erase period, but a strong discharge occurs, thereby forming abnormal charges. Methods for erasing the abnormal charges will now be described with reference to FIGS. 17 to 20.

FIGS. 17 to 20 show PDP drive waveforms according to further other exemplary embodiments.

Figure 17:
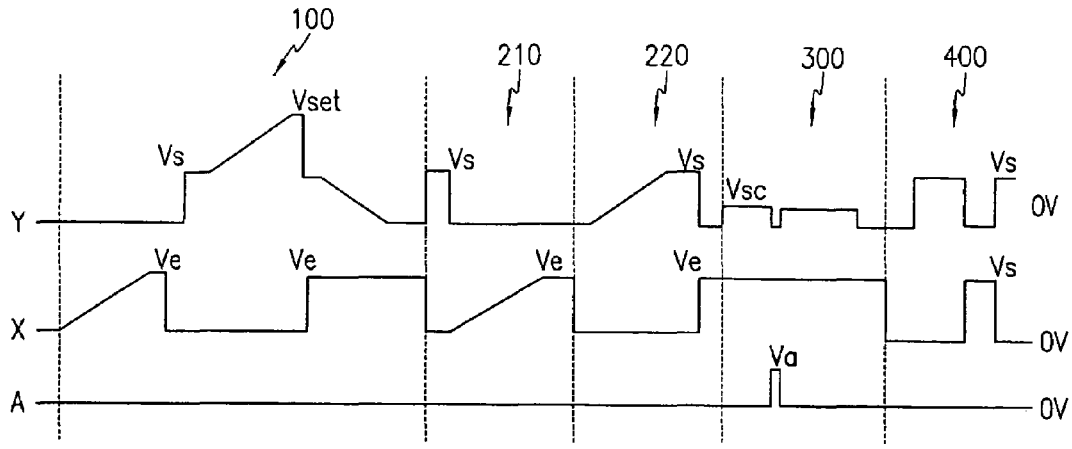

Referring to FIG. 17, the misfiring erase period includes a first misfiring erase period 210, which is substantially the same as the misfiring erase period 200 of FIG. 4, and a second misfiring erase period 220, which is substantially the same as the misfiring erase period 200 of FIG. 13. In this instance, a strong discharge may occur because of the rising ramp waveform applied to the sustain electrode X in the first misfiring erase period 210. If so, the charges may not be erased in the charge state of FIG. 6(*b*), but come to the charge state of FIG. 6(*a*). In this instance, a rising ramp waveform is applied to the scan electrode Y in the second misfiring erase period 220 to erase the charges in the charge state of FIG. 6(*a*).

Also, a narrow pulse or a round waveform which performs substantially the same function as that of the ramp waveform may be used instead of the ramp waveform during at least one of the misfiring erase periods 210 and 220. Hence, a pulse having an erase function is applied to the sustain electrode X and the scan electrode Y to thus perform a misfiring erase operation in FIG. 17.

Figure 18:
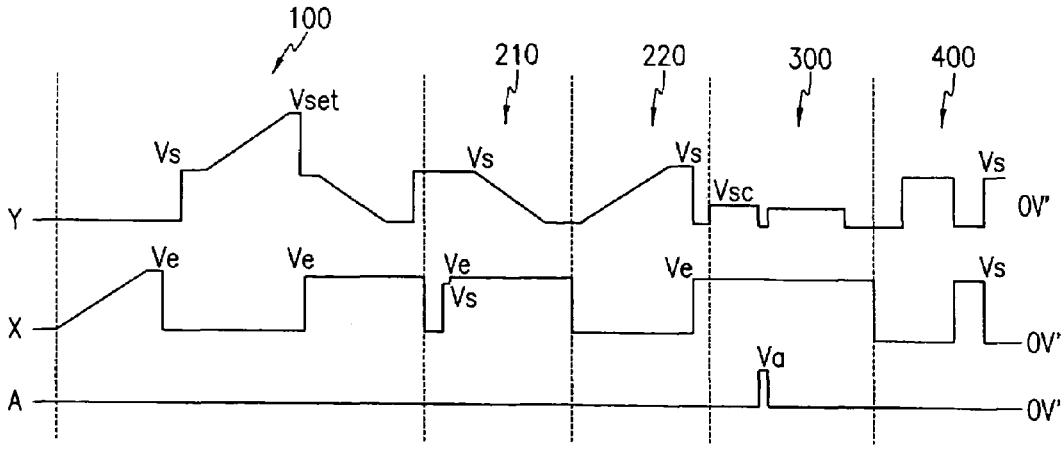

Referring to FIG. 18, the misfiring erase period includes a first misfiring erase period 210, which is substantially the same as the misfiring erase period 200 of FIG. 10, and a second misfiring erase period 220, which is substantially the same as the misfiring erase period 200 of FIG. 13. When a strong discharge occurs because of the falling ramp waveform applied to the scan electrode Y in the first misfiring erase period 210, the charges can be erased by the rising ramp waveform applied to the scan electrode Y in the misfiring erase period 220. Also, a narrow pulse or a round waveform which performs substantially the same function as that of the ramp waveform may be used instead of the ramp waveform during at least one of the misfiring erase periods 210 and 220. Hence, a pulse having an erase function is applied to the scan electrode Y to thus perform a misfiring erase operation in FIG. 18.

Figure 19:
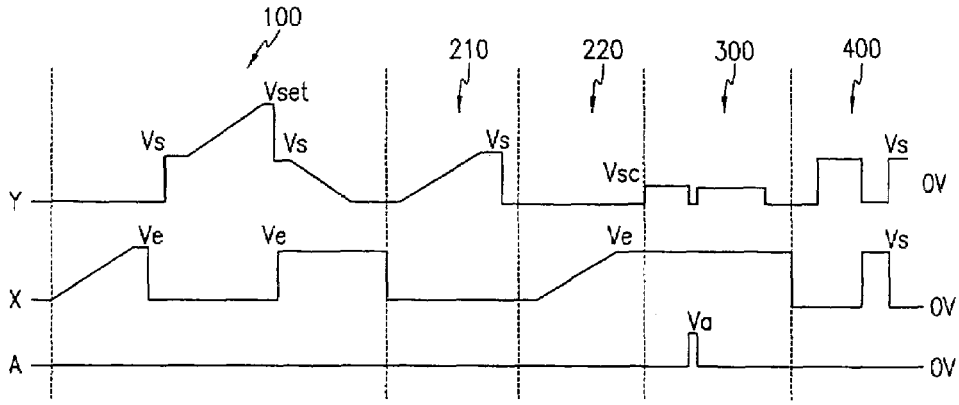

Referring to FIG. 19, the misfiring erase period includes a first misfiring erase period 210, which is similar to the misfiring erase period 200 of FIG. 13, and a second misfiring erase period 220, which is similar to the misfiring erase period 200 of FIG. 4. In the misfiring erase period 210, the voltage applied to the sustain electrode X does not rise to Ve at the latter part of the period unlike in the misfiring erase period 200 of FIG. 13. Further, the square pulse applied for inverting the polarities of the charges formed at the scan electrode Y and the sustain electrode X in the misfiring erase period 200 of FIG. 4 is not present in the second misfiring erase period 220. Therefore, when a strong discharge occurs in the first misfiring erase period 210 because of the rising ramp waveform applied to the scan electrode Y to reach the charge state of FIG. 6(*b*), the charges can be eliminated by the rising ramp (e.g., changed from a fifth voltage to a sixth voltage) and pulse applied to the sustain electrode X in the second misfiring erase period 220. Also, a narrow pulse or a round waveform which performs substantially the same function as that of the ramp waveform may be used instead of the ramp waveform during at least one of the first and second misfiring erase periods 210 and 220. Hence, a pulse having an erase function is applied to the scan electrode Y and the sustain electrode X to thus perform a misfiring erase operation in FIG. 19.

Figure 20:
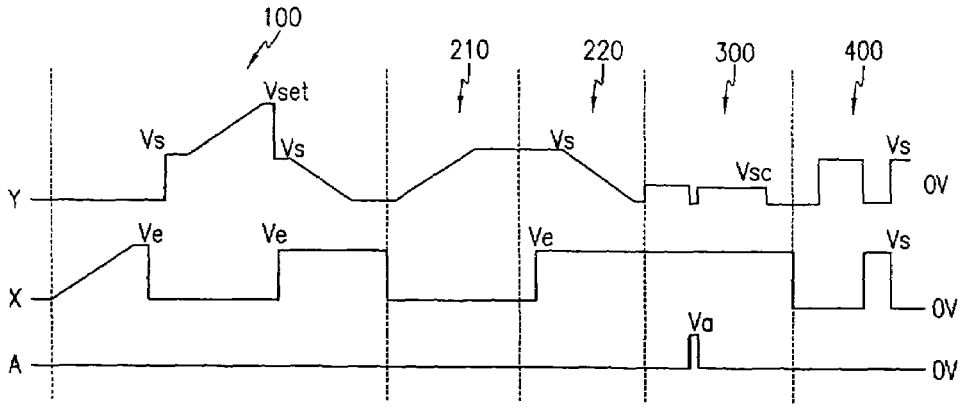

Referring to FIG. 20, the misfiring erase period includes a first misfiring erase period 210, which is similar to the misfiring erase period 200 of FIG. 13, and a second misfiring erase period 220, which is similar to the misfiring erase period 200 of FIG. 10. The square pulse applied for inverting the polarities of the charges formed at the scan electrode Y and the sustain electrode X in the misfiring erase period 200 of FIG. 13 is not present in the first misfiring erase period 210. Further, a step up of the voltage applied to the sustain electrode X from Vs to Ve in the early part of the misfiring erase period 200 of FIG. 10 is not present in the second misfiring erase period 220. Therefore, when a strong discharge occurs in the first misfiring erase period 210 because of the rising ramp waveform applied to the scan electrode Y to reach the charge state of FIG. 6(*b*), the charges can be eliminated by the falling ramp pulse applied to the scan electrode Y in the second misfiring erase period 220. Also, a round waveform which performs substantially the same function as that of the ramp waveform may be used instead of the ramp waveform during at least one of the first and second misfiring erase periods 210 and 220. Hence, a pulse having an erase function is applied to the scan electrode Y to thus perform a misfiring erase operation in FIG. 20.

In the above exemplary embodiments, methods for repeating the misfiring erase operation a number of times have been described with reference to FIGS. 14 to 20. For ease of description, the waveforms of FIGS. 14-20 each illustrate first and second misfiring erase periods/operations. However, in practice the misfiring erase periods/operations may be performed more than twice. The additional misfiring erase operations of FIGS. 14-20 may be referred to as additional setting or additional resetting.

According to the exemplary embodiments of the present invention, when strong discharging occurs because of an unstable reset operation in the reset period, and a large amount of charges are formed on the scan electrode and the sustain electrode, the charges can be erased. Therefore, generation of sustaining at the discharge cells that are not selected can be prevented.

While this invention has been described in connection with certain exemplary embodiments, it is to be understood that the invention is not limited to the disclosed exemplary embodiments, but, on the contrary, is intended to cover various modifications and/or equivalent arrangements included within the spirit and scope of the appended claims.

What is claimed is:

1. A method for driving a plasma display panel (PDP) comprising a plurality of first electrodes and second electrodes in parallel on a first substrate, and a plurality of third electrodes crossing the first and second electrodes and being on a second substrate, said first, second, and third electrodes defining a plurality of discharge cells, the PDP being driven during a plurality of subfields of a frame, at least one of the plurality of subfields comprising a first reset period, a second reset period immediately following the first reset period, an address period and a sustain period, the method comprising:

setting the plurality of discharge cells in the first reset period, wherein the first reset period comprises a rising voltage period and a falling voltage period, and a reset waveform applied to the first electrodes gradually rises during the rising voltage period and gradually falls during the falling voltage period;

further setting the plurality of discharge cells in the second reset period;

selecting at least one discharge cell from among the plurality of discharge cells in the address period; and discharging said at least one discharge cell in the sustain period.

2. The method of claim 1, wherein said further setting comprises applying a discharge erase pulse under a predetermined condition to the plurality of discharge cells, said discharge erase pulse having discharge and erase functions.

3. The method of claim 2, wherein the predetermined condition comprises a case in which abnormal charges are formed in the first reset period, and the abnormal charges formed in the first reset period are discharged and erased responsive to the discharge erase pulse.

4. The method of claim 3, wherein the abnormal charges comprise first and second charges respectively formed on the first and second electrodes in the first reset period, and a voltage caused by the first and second charges is sufficient for sustaining in the sustain period discharge cells that are not selected in the address period.

5. The method of claim 4, wherein the second reset period comprises a first period and a second period, and said further setting comprises:

applying a first voltage to the first electrode during the first period; and applying a second voltage to the second electrode during the second period.

6. The method of claim 5, wherein the first voltage, together with the voltage caused by the first and second charges, is sufficient for generating a discharge between the first and second electrodes.

7. The method of claim 6, wherein the first voltage has a voltage level substantially identical to that applied to the first electrode for discharging in the sustain period.

8. The method of claim 6, wherein charges accumulate responsive to the discharge in the first period to the first and second electrodes, and the second voltage is used in the second period to erase the charges formed in the first period.

9. The method of claim 8, wherein the second voltage gradually changes from a third voltage to a fourth voltage.

10. The method of claim 8, wherein the second voltage, together with a voltage caused by the charges formed in the first period, is sufficient for generating another discharge between the first and second electrodes, and charges accumulated to the first and second electrodes in the second period responsive to said another discharge is less than a predetermined amount of charges.

11. The method of claim 10, wherein the predetermined amount is within a range that prevents sustaining in the sustain period of the discharge cells that are not selected.

12. The method of claim 4, wherein a second voltage is applied to the second electrode while a first voltage is applied to the first electrode in the second reset period.

13. The method of claim 12, wherein the first voltage is applied to the first electrode during a predetermined period, a voltage difference between the first and second voltages, together with a voltage caused by the first and second charges, is sufficient for generating a discharge between the first and second electrodes, and charges accumulated to the first and second electrodes in the predetermined period responsive to the discharge is less than a predetermined amount of charges.

14. The method of claim 13, wherein the predetermined amount is within a range that prevents sustaining in the sustain period of discharge cells that are not selected.

15. The method of claim 13, wherein the first voltage has a voltage level substantially identical to that applied to the first electrode for discharging in the sustain period.

16. The method of claim 13, wherein the first voltage gradually changes from a third voltage to a fourth voltage.

17. The method of claim 1, further comprising additionally setting the plurality of discharge cells at least once more in at least one additional reset period.

18. The method of claim 17, wherein each of the second reset period and the at least one additional reset period comprises a first period and a second period, and each of said further selling and said additionally setting comprises:

applying a first voltage to the first electrode during the first period; and applying a second voltage to the second electrode during the second period.

19. The method of claim 18, wherein the first voltage has a voltage level substantially identical to that applied to the first electrode for discharging in the sustain period.

20. The method of claim 18, wherein the first voltage gradually changes from a third voltage to a fourth voltage.

21. The method of claim 20, wherein the fourth voltage has a voltage level substantially identical to that applied to the first electrode for discharging in the sustain period.

22. The method of claim 18, wherein the second voltage gradually changes from a fifth voltage to the sixth voltage.

23. The method of claim 22, wherein the fifth voltage has a voltage level substantially identical to that applied to the second electrode for discharging in the sustain period.

24. The method of claim 17, wherein each of the second reset period and the at least one additional reset period comprises a first period and a second period, and each of said further setting and said additionally setting comprises at least one of, applying a first voltage to the first electrode during the first period, and applying a second voltage to the second electrode during the second period.

25. The method of claim 24, wherein the first voltage gradually changes from a third voltage to a fourth voltage during the second reset period, and the second voltage gradually changes from a fifth voltage to a sixth voltage during the at least one additional reset period.

26. The method of claim 25, wherein the sixth voltage has a voltage level substantially identical to that applied to the second electrode for discharging in the sustain period.

27. The method of claim 25, wherein the fourth voltage has a voltage level substantially identical to that applied to the first electrode for discharging in the sustain period.

28. The method of claim 24, wherein the first voltage gradually changes from a third voltage to a fourth voltage during the second reset period, and the first voltage gradually changes from the fourth voltage to the third voltage during the at least one additional reset period.

29. The method of claim 28, wherein the third voltage has a voltage level substantially identical to that applied to the first electrode for discharging in the sustain period.

30. The method of claim 28, wherein the fourth voltage has a voltage level substantially identical to that applied to the first electrode for discharging in the sustain period.

31. A method for driving a plasma display panel (PDP) comprising a plurality of first electrodes and second electrodes in parallel on a first substrate, and a plurality of third electrodes crossing the first and second electrodes and being on a second substrate, said first, second, and third electrodes defining a plurality of discharge cells, the PDP being driven during a plurality of subfields of a frame, at least one of the plurality of subfields comprising a reset period and an erase period following the reset period, the reset period comprising a rising voltage period and a falling voltage period, and a reset waveform applied to the first electrodes gradually rises during the rising voltage period and gradually falls during the falling voltage period, the method comprising:

setting the plurality of discharge cells during the erase period depending on a charge condition provided in the reset period, said setting including generating a discharge and erasing, which comprise:

applying to the plurality of discharge cells a discharge pulse for generating the discharge between the first and second electrodes under the charge condition in the reset period; and applying to the plurality of discharge cells an erase pulse for erasing charges formed on the first and second electrodes responsive to the discharge.

32. The method of claim 31, wherein the charge condition for setting the plurality of discharge cells comprises a case in which abnormal charges have been formed in the reset period.

33. The method of claim 32, wherein the abnormal charges comprise first and second charges respectively formed on the first and second electrodes in the reset period, and a voltage caused by the first and second charges is sufficient for sustain-discharging in a sustain period discharge cells that are not selected in an address period.

34. The method of claim 33, wherein said setting the plurality of discharge cells comprises applying the discharge pulse having a first voltage to the first electrode while the second electrode is maintained at a second voltage, wherein a voltage difference between the first and second voltages, together with the voltage caused by the first and second charges, is sufficient to generate a discharge between the first and second electrodes.

35. The method of claim 34, wherein said applying the erase pulse comprises applying to the second electrode the erase pulse that gradually rises from a fourth voltage to a fifth voltage while the first electrode is maintained at a third voltage, and a voltage difference between the fifth and third voltages, together with a voltage caused by the charges formed on the first and second electrodes from the discharge generated through applying the discharge pulse, is sufficient to generate another discharge between the first and second electrodes.

36. The method of claim 34, said applying the erase pulse comprises applying to the second electrode the erase pulse that gradually falls from a fourth voltage to a fifth voltage while the first electrode is maintained at a third voltage, and a voltage difference between the third and fifth voltages, together with a voltage caused by the charges formed on the first and second electrodes from the discharge generated through applying the discharge pulse, is sufficient to generate another discharge between the first and second electrodes.

37. The method of claim 34, wherein said applying the erase pulse comprises applying to the second electrode the erase pulse having a fourth voltage for a predetermined period while the first electrode is maintained at a third voltage, a voltage difference between the fourth and third voltages, together with a voltage caused by the charges formed on the first and second electrodes from the discharge generated through applying the discharge pulse, is sufficient to generate another discharge between the first and second electrodes, and charges accumulated to the first and second electrodes in the predetermined period out of the charges formed by discharging between the first and second electrodes is less than a predetermined amount of charges.

38. The method of claim 37, wherein the predetermined amount is within a range that prevents discharging between the first and second electrodes when voltages of levels substantially identical to voltage levels respectively applied to the first and second electrodes are applied to the first and second electrodes in a sustain period.

39. A method for driving a plasma display panel (PDP) comprising a plurality of first electrodes and second electrodes in parallel on a first substrate, and a plurality of third electrodes crossing the first and second electrodes and being on a second substrate, the first, second, and third electrodes defining a plurality of discharge cells, the PDP being driven during a plurality of subfields of a frame, at least one of the plurality of subfields comprising a reset period and a setting period immediately following the reset period, the reset period comprising a rising voltage period and a falling voltage period, and a reset waveform applied to the first electrodes gradually rises during the rising voltage period and gradually falls during the falling voltage period, the method comprising:

setting the plurality of discharge cells during the setting period when a predetermined condition is provided in the reset period, said setting including generating a discharge and erasing, which comprise: applying to the plurality of discharge cells an erase pulse for generating the discharge between the first and second electrodes and erasing charges under the predetermined condition.

40. The method of claim 39, wherein the predetermined condition comprises a case in which abnormal charges have been formed in the reset period.

41. The method of claim 40, wherein the abnormal charges comprise first and second charges respectively formed on the first and second electrodes, and a voltage caused by the first and second electrodes is sufficient for sustain-discharging in a sustain period discharge cells that are not selected in an address period.

42. The method of claim 41, wherein said applying the erase pulse comprises applying the erase pulse having a second voltage for a predetermined period to the first electrode while the second electrode is maintained at a first voltage, a voltage difference between the second and first voltages, together with a voltage caused by the first and second charges, is sufficient for generating a discharge between the first and second electrodes, and charges accumulated to the first and second electrodes in the predetermined period out of the charges formed by discharging between the first and second electrodes less than a predetermined amount of charges.

43. The method of claim 42, wherein the predetermined amount is within a range that prevents discharging between the first and second electrodes when voltages having levels substantially identical to voltage levels respectively applied to the first and second electrodes are applied to the first and second electrodes in a sustain period.

44. The method of claim 41, wherein the erase pulse that gradually changes from a second voltage to a third voltage is applied to the first electrode while the second electrode is maintained at a first voltage.

45. The method of claim 44, wherein the voltage difference between the third and first voltages, together with a voltage caused by the first and second charges, is sufficient to generate a discharge between the first and second electrodes.

46. A plasma display panel (PDP) comprising:

a first substrate;

a plurality of first and second electrodes substantially in parallel on the first substrate;

a second substrate facing the first substrate with a predetermined distance therebetween;

a plurality of third electrodes crossing the first and second electrodes, and being on the second substrate; and a driving circuit for supplying a driving signal to a discharge cell defined by adjacent said first, second, and third electrodes, the driving circuit for driving the PDP during a plurality of subfields of a frame, at least one of the plurality of subfields comprising a reset period and an address period, the reset period comprising a rising voltage period and a falling voltage period, and a reset waveform applied to the first electrodes gradually rises during the rising voltage period and gradually falls during the falling voltage period wherein the driving circuit applies a first voltage to the first electrode and a second voltage to the second electrode between the reset and address periods, and abnormal charges from among charges formed in the reset period are erased by the first and second voltages.

47. The PDP of claim 46, wherein the abnormal charges comprise first and second charges respectively formed on the first and second electrodes, wherein the first and second charges are sufficient to generate a discharge in a sustain period when the discharge cell is not selected in the address period.

48. The PDP of claim 47, wherein the driving circuit applies the first voltage to the first electrode during a first period, and the second voltage to the second electrode during a second period, and when the first and second charges are formed during the reset period, discharging occurs between the first and second electrodes responsive to the first voltage during the first period, and charges formed by discharging in the first period are erased responsive to the second voltage during the second period.

49. The PDP of claim 48, wherein, during the first period, the driving circuit applies the first voltage to the first electrode while maintaining the second electrode at a third voltage, and a voltage difference between the first and second voltages, together with a voltage caused by the first and second charges, is sufficient to generate a discharge between the first and second electrodes.

50. The PDP of claim 49, wherein, during the second period, the driving circuit applies the second voltage to the second electrode while maintaining the first electrode at a fourth voltage, the second voltage gradually changes from a fifth voltage to a sixth voltage, and a voltage difference between the sixth and fourth voltages, together with a voltage caused by the charges formed though discharging between the first and second electrodes, is sufficient to generate another discharge between the first and second electrodes.

51. The PDP of claim 49, wherein, during the second period, the driving circuit applies the second voltage to the second electrode while maintaining the first electrode at a fourth voltage, a voltage difference between the second and fourth voltages, together with a voltage caused by the charges formed through discharging between the first and second electrodes, is sufficient to generate another discharge between the first and second electrodes, and charges accumulated to the first and second electrodes in the second period of the charges formed by discharging said another discharge is less than a predetermined amount of charges.

52. The PDP of claim 51, wherein the predetermined amount is within a range that prevents discharging between the first and second electrodes when voltages of levels substantially identical to voltage levels respectively applied to the first and second electrodes are applied to the first and second electrodes in a sustain period.

53. The PDP of claim 47, wherein the driving circuit applies the second voltage to the second electrode, and the first voltage to the first electrode, and the first and second charges are erased responsive to the first and second voltages.

54. The PDP of claim 53, wherein the driving circuit applies the first voltage for a predetermined period, a voltage difference between the first and second voltages, together with a voltage caused by the first and second charges, is sufficient to generate a discharge between the first and second electrodes, and charges accumulated to the first and second electrodes in the predetermined period out of the charges formed by discharging between the first and second electrodes is less than a predetermined amount of charges.

55. The PDP of claim 54, wherein the predetermined amount is within a range that prevents discharging between the first and second electrodes when voltages of levels substantially identical to voltage levels respectively applied to the first and second electrodes are applied to the first and second electrodes in a sustain period.

56. The PDP of claim 53, wherein the second voltage gradually changes from a third voltage to a fourth voltage, and a voltage difference between the fourth and first voltages, together with a voltage caused by the first and second charges is sufficient for generating a discharge between the first and second electrodes.

57. The PDP of claim 46, wherein the driving circuit applies the first voltage to the first electrode and the second voltage to the second electrode at least once more between the reset and address periods.

58. The PDP of claim 57, wherein at least one of the first and second voltages gradually changes from a third voltage to a fourth voltage.

59. The PDP of claim 57, wherein the second voltage gradually changes from a third voltage to a fourth voltage during a first application of the first and second voltages, and the first voltage gradually changes from a fifth voltage to a sixth voltage during a second application of the first and second voltages.

60. The PDP of claim 57, wherein the first voltage gradually changes from a third voltage to a fourth voltage during a first application of the first and second voltages, and the first voltage gradually changes from the fourth voltage to the third voltage during a second application of the first and second voltages.

61. The PDP of claim 46, wherein the first voltage gradually changes from a third voltage to a fourth voltage during a first period, and the second voltage gradually changes from a fifth voltage to a sixth voltage during a second period, wherein the first and second periods are between the reset and address periods.

62. The PDP of claim 46, wherein the first voltage gradually changes from a third voltage to a fourth voltage during a first period, and the first voltage gradually changes from the fourth voltage to the third voltage during a second period, wherein the first and second periods are between the reset and address periods.

* * * * *

UNITED STATES PATENT AND TRADEMARK OFFICE

CERTIFICATE OF CORRECTION

PATENT NO. : 7,468,712 B2
APPLICATION NO. : 10/796597
DATED : December 23, 2008
INVENTOR(S) : Jin-Boo Son et al.

It is certified that error appears in the above-identified patent and that said Letters Patent is hereby corrected as shown below:

| | |
|---|---|
| Column 13, line 50, Claim 18 | Delete “selling”,<br>Insert --setting-- |
| Column 17, line 26, Claim 50 | Delete “though”,<br>Insert --through-- |

Signed and Sealed this

Twenty-first Day of April, 2009

John Doll

JOHN DOLL
*Acting Director of the United States Patent and Trademark Office*